US006312099B1

(12) United States Patent
Hawkins et al.

(10) Patent No.: US 6,312,099 B1
(45) **Date of Patent: *Nov. 6, 2001**

(54) PRINTING UNIFORMITY USING PRINTHEAD SEGMENTS IN PAGEWIDTH DIGITAL PRINTERS

(75) Inventors: Gilbert A. Hawkins, Mendon; Xin Wen; William Y. Fowlkes, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/784,668

(22) Filed: Jan. 21, 1997

(51) Int. Cl.[7] ..... B41J 2/155
(52) U.S. Cl. ..... 347/42; 347/13; 347/40
(58) Field of Search ..... 347/12, 13, 42, 347/48, 41, 68, 40; 400/120

(56) References Cited

U.S. PATENT DOCUMENTS

| | | | | |
|---|---|---|---|---|
| 3,946,398 | | 3/1976 | Kyser et al. | 347/70 |
| 4,275,290 | * | 6/1981 | Cielo et al. | 347/48 |
| 4,622,561 | | 11/1986 | Koike | 347/41 |
| 4,788,557 | * | 11/1988 | Hawkins | 347/68 |
| 4,999,646 | | 3/1991 | Trask | 347/41 |
| 5,057,854 | * | 10/1991 | Pond et al. | 347/42 |
| 5,132,702 | * | 7/1992 | Shiozaki et al. | 347/12 |
| 5,160,945 | * | 11/1992 | Drake | 347/42 |
| 5,384,587 | | 1/1995 | Takagi et al. | 347/41 |
| 5,550,568 | * | 8/1996 | Misumi | 347/12 |
| 5,745,131 | * | 4/1998 | Kneezel | 347/43 |

FOREIGN PATENT DOCUMENTS

| | | | |
|---|---|---|---|
| 0 539 157 A2 | 4/1993 | (EP) | B41J/2/21 |
| 2 007 162 A | 5/1979 | (GB) | B41J/3/04 |

* cited by examiner

*Primary Examiner*—N. Le
*Assistant Examiner*—Lamson D. Nguyen
(74) *Attorney, Agent, or Firm*—Walter S. Stevens

(57) ABSTRACT

A binary pagewidth printhead without substantial grayscale capability includes an array of adjacent printhead segments that are distributed across the pagewidth printhead so that adjacent segments overlap at their ends by a predetermined distance. A plurality of printing pixels extending along each segment have physical differences that effect substantially non-uniform transfer functions that decrease toward the ends of segments over the overlap distance. The physical characteristics of the printing pixels are such the their transfer functions vary linearly over the overlap distance. The physical characteristics of the printing pixels may be such the their transfer functions increase monotonically from a small value at the ends of the printhead segments to a larger value away from the ends of the printhead segments. The physical characteristics of the printing pixels in a central portion of each segment are preferably uniform such the their transfer functions are constant over the central portions. Preferably, the transfer functions applied to adjacent segments are of mirror symmetry.

22 Claims, 10 Drawing Sheets

PRINTING UNIFORMITY USING PRINTHEAD SEGMENTS IN PAGEWIDTH DIGITAL PRINTERS

CROSS-REFERENCE TO RELATED APPLICATION

Reference is made to commonly assigned, U.S. patent applications Ser. No. 08/615,366 entitled PRINTING UNIFORMITY USING NARROW PRINTHEAD SEGMENTS IN DIGITAL PRINTERS, filed in the names of X. Wen and W. Fowlkes on Mar. 14, 1996 now U.S. Pat. No. 5,767,874, and U.S. Ser. No. 08/750,438 filed in the name of K. Silverbrook and corresponding to PCT/US96/04887 filed Apr. 9, 1996 now U.S. Pat. No. 5,880,759.

BACKGROUND OF THE INVENTION

1. Technical Field

This invention relates generally to digital ink jet printers, and more specifically to such printers that have narrow printhead segments which produce adjacent bands of printed pixels.

2. Background Art

Printheads narrower than the page width, such as disclosed in U.S. Pat. No. 5,384,587, which issued to Takagi et al. on Jan. 24, 1995, require multiple parallel swaths the printing each image plane, as shown in FIG. 1, wherein a narrow printhead prints one image plane by multiple parallel swaths. The width of the swaths is determined by the width of the printhead. Whereas the narrower printheads have the advantage of lower cost, they are very slow.

The printing speed of digital printers depends on the width of the printhead. A cross-the-page, full width printhead can print an image plane in a single pass, and is therefore most desirable for high speed printing. But full width printheads have the disadvantages of being more difficult and costly to fabricate because a single defect in the head makes an entire head defective. Page-width printers of the continuous ink jet type made from a single array of nozzles are known to the art but have not found use in high quality printing applications due in part to difficulties obtaining a high density of nozzles and to the need for ink recirculation. Page-width ink jet printheads, of the drop on demand type, have the disadvantage of not being cost effective due in large part to difficulties of thermal management and printhead lifetime.

One approach to a full width printhead is to use an array of narrow printhead segments laid out across the page, as shown in FIG. 2. The printhead segments are distributed in a staggered fashion so that the printing areas of the neighboring segments overlap with each other, as shown in FIG. 3. This design saves cost and also allows the flexibility of being able to separately replace each individual printhead segment if one becomes defective. However, "banding" defects often occur at the interface between adjacent printhead segments.

As used herein, the phrase "printing pixel" refers to the printhead structure that effects modulation of the media to cause a printed pixel. The printing pixel may be, for example, a resistive heating element, an ink jet nozzle, or a light source.

Banding is caused by miss-registration between the printhead segments of the array. For example, if adjacent printhead segments overlap by one printing pixel, a dark line occurs in the overlap. Likewise, if there is a one pixel-wide gap between adjacent printhead segments of the array, a line will not be printed, leaving a white line in between the two segments. This problem exists in both continuous tone and halftone, and in different types of digital printers (such as those using resistive thermal, ink jet, laser, and silver halide technologies).

In U.S. Pat. No. 5,384,587, which issued to Takagi et. al., the problem of banding-is recognized for multi-drop ink-jet printing. The patent discloses a method to reduce banding by overlapping the printhead scans. In the overlap region, each media printed pixel receives some drops of ink from a nozzle at one end of the printhead and then on a subsequent scan receives additional drops of ink from a nozzle near the other end of the printhead, the total number of drops ideally equaling the number of drops which would have been received by a single printhead whose scans were not overlapped. By altering the number of drops delivered by nozzles at each end of the printhead from a constant number characteristic of the number of drops delivered by nozzles in the middle of the printhead to a much smaller number at the printhead end, banding in the overlap region is reduced. The number of ink droplets is gradually decreased toward a discharging portion disposed in an edge portion of the recording head. U.S. Pat. No. 5,384,587 also teaches methods whereby multiple drops deposited during subsequent scans can be spaced apart to compensate for spreading effects of multiple ink drops not deposited simultaneously but instead deposited during separate scans, an effect dependent on the ink-paper interactions.

U.S. Pat. No. 4,622,561 also teaches a method to reduce banding by overlapping the printhead scans. Subsequent scans are stepped by 50% of the scan width of a single scan, and the centers of the ink drops deposited during each scan are displaced by one half of one pixel. This method also reduces the sensitivity of banding to accidental displacements of printhead scans and provides uniformity and consistency of dot formation. U.S. Pat. No. 4,999,646 also teaches a method to reduce banding by overlapping the printhead scans by depositing first and second partially overlapping complementary dot patterns displaced by half the final dot-to-dot spacing to promote uniform and consistent drying.

European patent application 0,539,157,A2 by Hirabayashi et al. teaches a method of reduction of color banding during multi-color ink jet printing caused by edge displacement of two colors co-deposited in the same location but at different times. The time delay between deposition of subsequent dots of different colors in the same spatial location produces different banding on each end of the scanned printhead. For cases of multiple printheads, each of which print different colors and which print color mixtures by superposing two dots of complementary colors, the spread of the ink dot last deposited is reduced. This reduction is beneficial near the ends of the printhead, particularly near the leading edge of the scan lines. Alternately, the printhead is displaced during a second scan so that the edge of the second color dot deposited is displaced away from the leading edge of the scan line. The amount of such deliberate displacement of the edge of the second color drop is not large compared to the dot sizes. European patent application 0,539,157,A2 does not teach overlapping scans of similar colors.

The occurrence of banding may be understood quantitatively from a consideration of a printhead actuation function, a printhead transfer function, and a media modulation function. The printhead actuation function describes how printhead printing pixels are actuated across a printhead or a printhead segment. The transfer function describes the extent to which each actuated printing pixel provides media modulation for a given level of activation. The media modulation function, which is approximately the product of the printhead actuation function and the printhead transfer function, describes the resultant modulation by the printhead of the media sheet on which the image is printed. Modulation of the media results in a visible image.

The actuation function applied to the printing pixels of the printhead and the media modulation function applied by each printing pixel of a printhead to the corresponding pixels of the media sheet depend on the type of media and the type of printhead. For example, the actuation function applied to a thermal printhead or to an ink jet printhead might be in the form of a voltage pulse of a certain amplitude and duration given to each printing pixel. Such voltage pulses are shown schematically in FIG. 4A. Also, by way of example, the media modulation function applied to the media might constitute heat energy in the case of thermal printing or ink drops in the case of ink jet printing. The transfer functions in these examples might describe the amount of heat delivered per volt of actuation in the case of thermal printing, or the number of ink drops delivered to the media per volt of actuation in the case of ink jet printing.

As is common in the art, the actuation function for each printing pixel is timed so as to account for the position of the printhead printing pixels in relation to the media printed pixels where the media modulation was desired to be applied. For simplicity, it is assumed that the printing pixels of a printhead segment form a line perpendicular to the direction of motion of the media sheet. Therefore, the actuation function shown in FIG. 4A corresponds to simultaneous voltage pulses applied to the printing pixels of the printhead to print a line on the media sheet. Other possibilities, such as angulation of the head are well know in the art and require different actuation timing schemes.

The actuation function shown in FIG. 4A corresponds to printing of a uniform line on the media sheet, but this is not the most general case. In general, it is desired to vary the optical density produced on the media sheet. The type of variation possible depends on the printing means. Some printing means, such as thermal printing, have extensive grayscale capability in the sense that the actuation function of the printhead typically has many possible values, corresponding to production by the printhead of many values for the media modulation function, resulting in the creation of pixels on the media with a corresponding range of optical densities. In the case of thermal printing, the printhead activation function (voltage) is varied to produce many levels for the value of the media modulation function (heat applied by the printhead pixel to a donor transfer medium) resulting in many values for the optical density of each printed pixel in the image plane. In other printing means, such as thermal ink jet printing, it is well known in the art that the amount of dye or ink transferred from any one printhead nozzle upon activation onto the image plane cannot be substantially varied. Such printing means are said to have no grayscale capability or very limited grayscale capability.

Actuation, media modulation, and transfer functions for selected printing means discussed below are illustrated in FIGS. 4B–4D. In the case of printers having grayscale capability at each printing pixel, such as thermal printers, a typical actuation function might look like that shown in FIG. 4B, which shows voltages of various amplitudes applied to the printing pixels of a printhead. The media modulation function applied to the media sheet by any printing pixel is varied by varying the actuation function of the corresponding printing pixel. On the other hand, for printers with printing pixels having little or no grayscale capability, a typical actuation function might look like that shown in FIG. 4C, which shows voltages of amplitudes ONE or ZERO applied to the printing pixels of a printhead.

The ratio of the modulation function applied to the media sheet by a particular printing pixel to the actuation function applied to the corresponding printhead printing pixel is the printing pixel transfer function. In the case of thermal printing, the transfer function is given primarily by the amount of heat energy applied by a resistive element to the media sheet for a given level of printhead actuation voltage. For an ink jet printer, the transfer function is primarily given by the amount of ink ejected from a nozzle and, to a lesser extent, by the drop-paper interaction. (In each case, as is well known in the art, effects such as the duration of the voltage pulse may also determine the transfer function).

As generally practiced, the transfer functions of all printing pixels with or without grayscale capability in a printhead are made as uniform as possible to simplify printing and lead manufacturing. Such a uniform transfer function is shown schematically in FIG. 4D, and would apply equally well to actuation function 4B (grayscale) or actuation function 4C (no grayscale).

Uniformity of the printhead transfer function for a pagewidth thermal printhead is highly desired and is reflected in the tight specifications for manufacturing variations between printing pixel resistive elements. Likewise in conventional ink jet pagewidth printheads, nozzles are uniform and the droplets of ink deposited from nozzles in a given printhead are substantially uniform. As is well known in the art, care is taken in the manufacture of such printhead segments to ensure uniformity.

In a printhead for which at most only one printing pixel contributes to a given media sheet printed pixel, the modulation function applied to the media sheet at a given printed pixel is approximated by the product of the actuation function for that pixel multiplied by the transfer function for that printing pixel.

For pagewidth printheads comprised of multiple overlapping printhead segments, the modulation function applied to the media sheet at any given printed pixel is approximated by summing the product of the actuation function and transfer functions for the printing pixels of any printhead segments that contribute to the particular media printed pixel. As is well know in the art of ink jet printheads, some corrections may be needed in this calculation due to the size of ink drops or the time delay between ink drops from different printhead segments. This is illustrated in FIGS. 4E–4I which shows two printhead segment actuation functions, transfer functions, and the resultant modulation function applied to the media sheet, for a case of perfect alignment of the printing pixels of the printhead segments.

If the alignment of the two printhead segments is not perfect, it is possible that a printed pixel on the image plane in the region of overlap may receive an ink droplet from each of two printhead segments, resulting in an undesirable non-uniformity or banding in the region of overlap, as will next be described.

The printing by two adjacent printhead segments that have a single-pixel overlap, caused for example by misalignment, is graphically represented by actuation, transfer, and media modulation functions of FIGS. 5A–5E corresponding to FIGS. 4E–4I (no misalignment), respectively. Again, the total modulation function applied to the media sheet is the sum of the actuation functions multiplied by the transfer functions of all the segments in the printhead array. FIG. 5E illustrates the modulation function applied to the media sheet by the modulation functions of FIGS. 5A and 5B and transfer functions of FIGS. 5C and 5D. Note that a dark band will result at the overlap, as indicated by the positive spike in the modulation function of FIG. 5E.

Printing by two adjacent printhead segments that have a single-pixel gap is graphically represented by modulation functions of FIGS. 6A–6E similar to FIGS. 5A–5E, respectively. Once again, the total modulation function applied to the media sheet is the sum of the actuation functions multiplied by the transfer functions of all the segments in the printhead array. FIG. 6E illustrates the modulation function applied to the media sheet by the modulation functions of FIGS. 6A and 6B and the transfer functions of FIGS. 6C and 6D. Note that a light band will result at the gap, as indicated by the negative spike in the modulation function of FIG. 6E.

DISCLOSURE OF THE INVENTION

It is an object of the present invention to provide a printhead array design that minimizes the banding problem for pagewidth printheads comprised of printhead segments of the type which have no grayscale or very limited grayscale capability, for example ink jet printheads as are now commonly practiced.

According to one feature of the present invention, a pagewidth printhead without substantial grayscale capability (binary printhead) includes an array of adjacent printhead segments that are distributed across the printhead so that adjacent printhead segments overlap at their ends by a predetermined distance. A plurality of printing pixels extending along each printhead segment have physical differences that effect non-uniform transfer functions whose values decrease toward the ends of segments over the overlap distance.

In a preferred embodiment of the present invention, the physical characteristics of the printing pixels are such the their transfer functions vary linearly over the overlap distance. The physical characteristics of the printing pixels may be such the their transfer functions increase monotonically from a very small value at the ends of the printhead segments to a much larger value away from the ends of the printhead segments. The physical characteristics of the printing pixels in a central portion of each segment are preferably uniform with transfer functions which are constant over the central portions. Preferably, the transfer functions applied to adjacent segments are of mirror symmetry.

According to another feature of the present invention, the uniform transfer functions illustrated in FIGS. 4C, 4D, 5C, 5D, 6C, and 6D are replaced by transfer functions that gradually change from ONE to ZERO over a range of printing pixels by means of physical alteration of the printhead printing pixels at each end of the printhead segments. These gradually-changing transfer functions at the ends of each printhead segment have the following properties:

1. The sum of the nth and $(n+1)^{th}$ media modulation function resulting from the new transfer functions is substantially equal to one when the activation functions are uniform.
2. The transfer function may monotonically vary from ZERO to ONE, or vice versa, along the x-direction in a range wider than one printing pixel.
3. The $n^{th}$ and $(n+1)^{th}$ transfer functions act such as to cause the modulation functions to have mirror symmetry relative to the border between printhead segments for uniform activation functions.

According to a feature of the present invention, a recording method for an ink jet printer having a printhead formed of an array of narrow printhead segments that are distributed across the printhead so that there is an overlap region at the boundary between adjacent segments includes providing a modulated size of the nozzles at each end of each printhead segment in the overlap region, the modulated size gradually decreasing from a normal size, characteristic of the central section of the printhead segments, to a substantially smaller size toward each end of the said printhead segments. The timing of the activation in a printing system utilizing such printhead segments is such as to place the printed ink dots from the two adjacent printheads in substantially the same location.

According to another feature of the present invention, a recording method for an ink jet printer having a printhead formed of an array of narrow printhead segments that are distributed across the printhead so that there is an overlap region at the boundary between adjacent segments includes activating nozzles in the overlap region of adjacent printhead segments so that nozzles from each of the printhead segments that correspond to the same row of printed pixels are either both activated or both non-activated. In the case both nozzles are so activated, the timing of the activation is such as to place the printed ink dots from the two adjacent printheads in substantially the same location.

In another preferred embodiment of the present invention, the modulation functions applied to adjacent segments are of a symmetry such that if, in the region of overlap between a first and a second printhead segment, a printed pixel on the media receives ink from one printing pixel of a first printhead segment, it also receives ink from the second printhead segment. The printhead is as wide as a full print line across the media, and the segments are staggered across the printhead.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
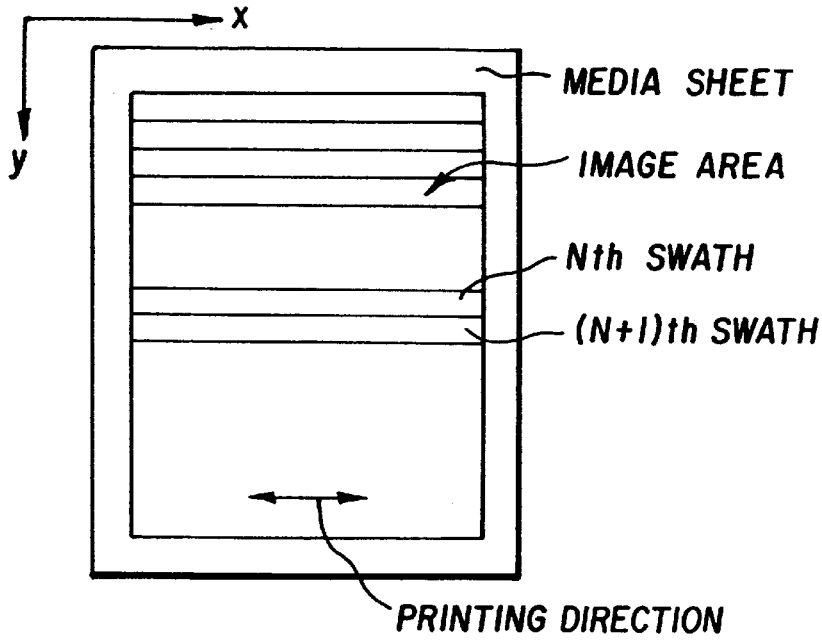
FIG. 1 (prior art)
FIG. 1 shows print areas of adjacent passes of a printhead segment according to the prior art.
Figure 2:
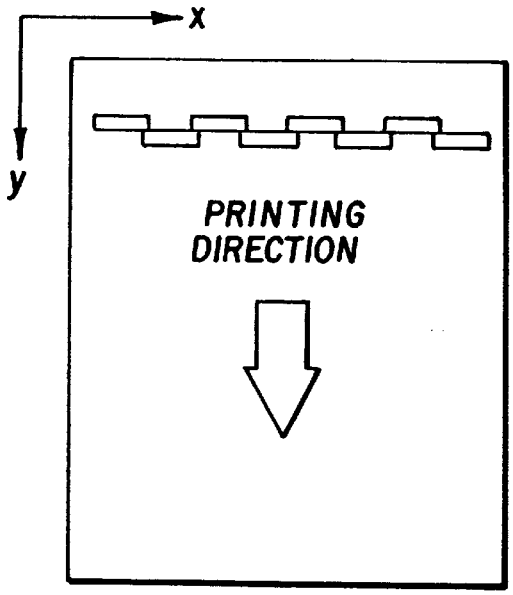
FIG. 2 illustrates the layout of an embodiment of a printhead array of segments that is consistent with this invention.
Figure 3:
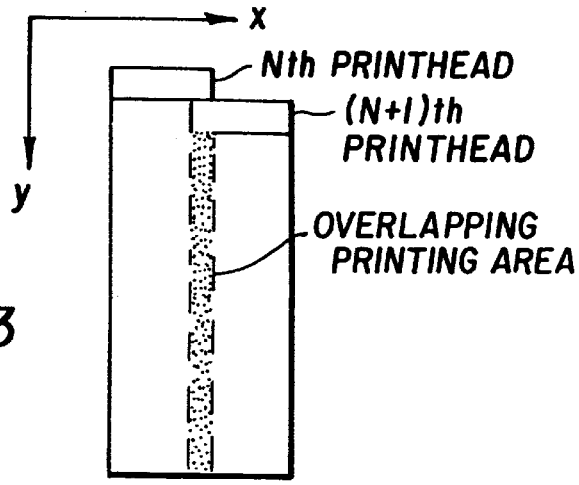
FIG. 3 shows an overlapping print area of two adjacent segments of the printhead array of FIG. 2.
Figure 4A:
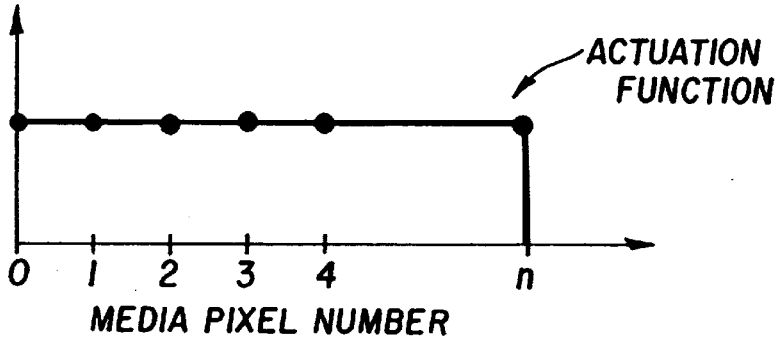
FIGS. 4A–4I graphically represent actuation, transfer, and modulation functions of printhead segments according to the prior art for uniform activation functions and perfect alignment of the printhead segments.
Figure 4B:
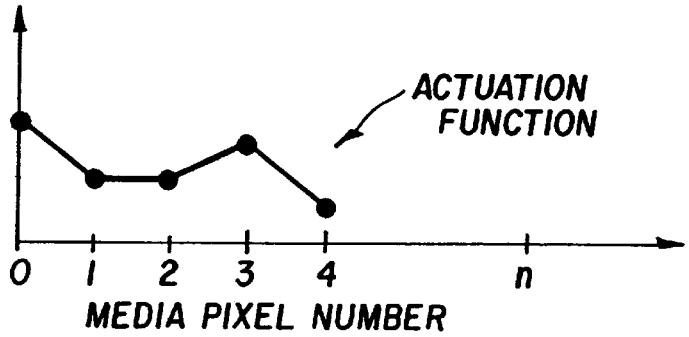
Figure 4C:
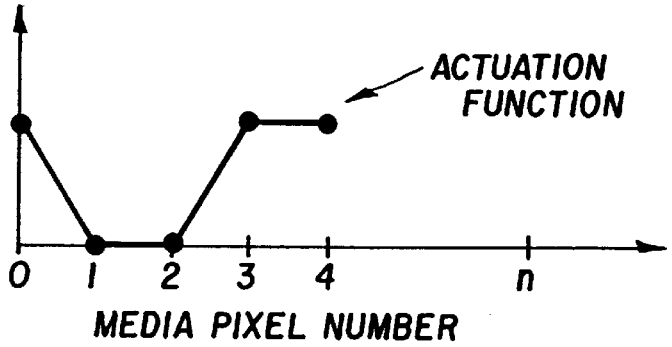
Figure 4D:
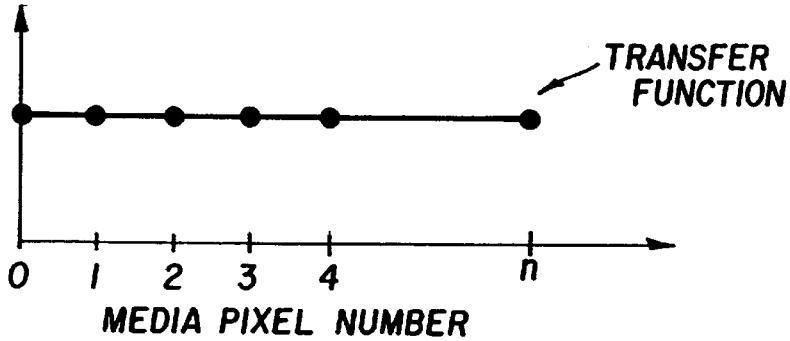
Figure 7A:
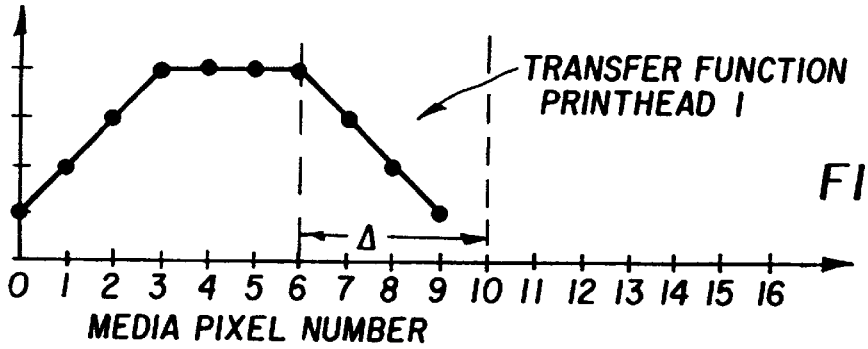
FIGS. 7A–7E graphically represent actuation, transfer, and modulation functions of two overlapping adjacent printhead segments in perfect alignment according to the present invention.

In the present invention, as in the prior art for all printers without substantial grayscale capability, modulation functions such as those shown in FIGS. 4A and 4B, describe whether or not a particular printhead printing pixel is activated and are adequately represented as having the value "one" (printhead printing pixel activated) or "zero" (not activated). However, according to the present invention, the printing pixels of a printhead segment are deliberately constructed with physical differences from printing pixel to printing pixel so as to deposit different amounts of ink when given the same activation pulse depending upon their location along the printhead segment. In particular, a page-width printhead is provided with overlapping printhead segments, in which the printing pixels in each print head segment in the region of overlap (that is at the ends of the printhead segments) deposit smaller amounts of ink on the image plane when activated than do those printing pixels in the central portion of the printhead when similarly activated. In a preferred embodiment, the amount of ink deposited on a media sheet by the printing pixels of a printhead segment increases monotonically from a small value at the ends of the printhead segment to a larger value away from the ends of the printhead segment for equal activations. The amount of ink so deposited for a uniform activation function is altered along a given printhead segment by a transfer function of the type shown in FIG. 7A. The printing pixels in the central portion of the printhead segment whose transfer function is shown in FIG. 7A are of uniform construction and so deposit identical amounts of ink when activated. The physical construction of the printing pixels near the ends of the printhead segment is altered so that the media modulation functions decrease near the ends even when all activation functions are equal.

Figure 7B:
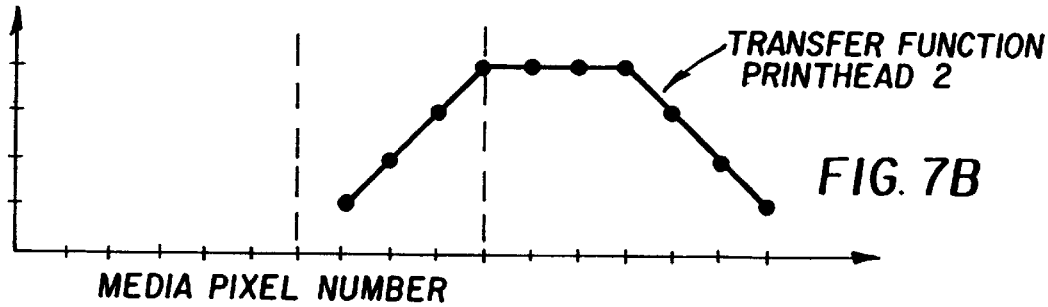
Figure 7C:
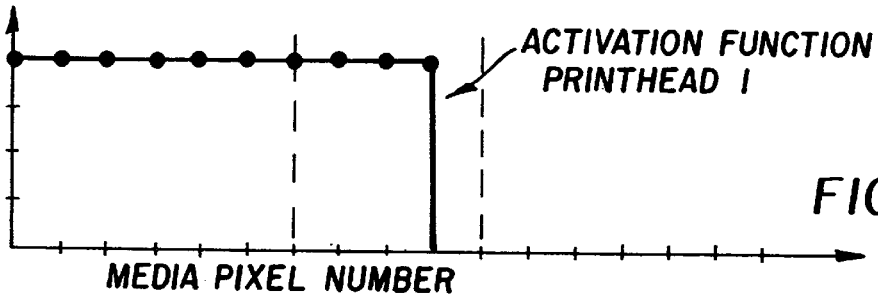
Figure 7D:
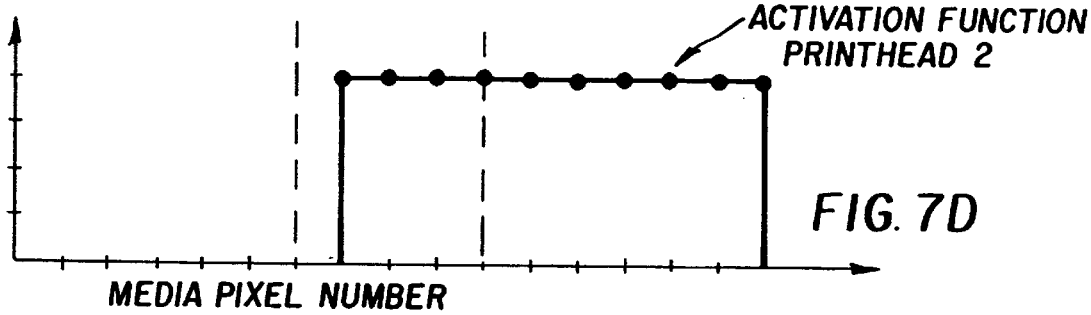
Figure 7E:
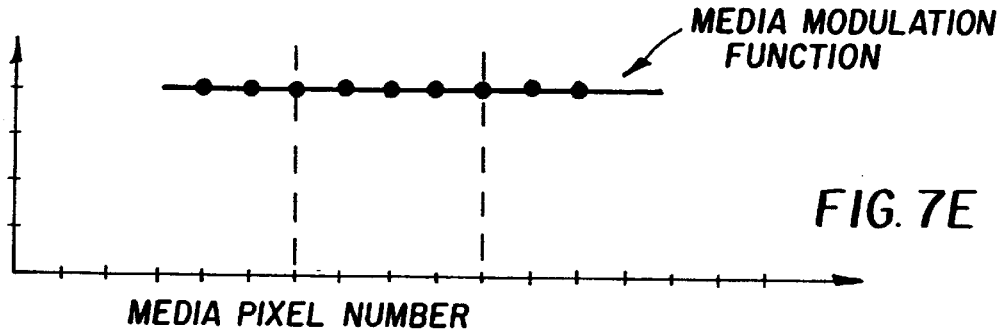

Referring to FIGS. 7A–7E, the discussion may be simplified by assuming that the image density of a printed pixel on an image plane is determined approximately by the volume of ink deposited. Thus, if the vertical axis of the graph of FIG. 7A represents the volume of ink deposited by activated printing pixels along the length of a printhead segment for a particular uniform printhead activation function shown in FIG. 7C, and if FIG. 7B represents a transfer function for a second and overlapping printhead segment whose activation function is shown in FIG. 7D, the image density printed on an image plane from two printhead segments which overlap by N printing pixels can be approximately determined by adding the media modulation functions of the two printhead segments together as shown in FIG. 7E. The transfer functions are chosen to produce the media modulation function of FIG. 7E. When the relative displacement of the two printhead segments is as shown in FIGS. 7A–7D, the transfer functions will be preferably approximately linear in the overlap regions. As discussed, the printing pixels of the printhead segments are activated so as to produce a single line of printing pixels on the image plane, for example by timing the activation of the printing pixels of the printhead segments as they move with respect to the image plane, as is well known in the art.

If the transfer functions of FIGS. 7A and 7B are represented by Equation 1 below, corresponding to symmetrically constructed printhead segments overlapped a distance Δ shown in FIG. 7A with linearly ramped amounts of ink delivered from the N printing pixels at the ends of the printhead segments, then the media modulation function of the two printhead segments around the region of overlap is uniform as shown in FIG. 7E, assuming that all printing pixels of each printhead segment are activated as in FIGS. 7A and 7B.

Transfer Function — Equation 1

$$\text{Printhead Segment 1} \quad \begin{cases} a - \dfrac{x(a-b)}{\Delta} & \Delta \geq x \geq 0 \\ a & x < 0 \end{cases}$$

$$\text{Printhead Segment 2} \quad \begin{cases} (a-b)\dfrac{x}{\Delta} + b & 0 < x \leq \Delta \\ a & x > \Delta \end{cases}$$

Figure 4E:
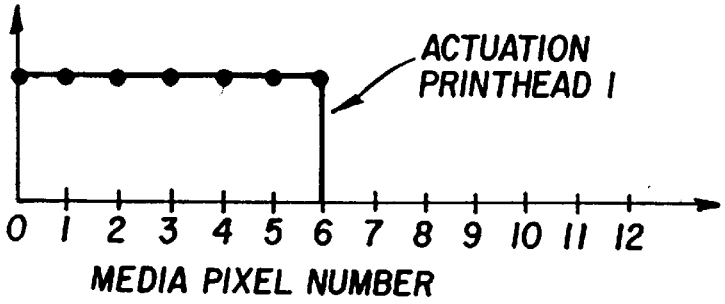
Figure 4F:
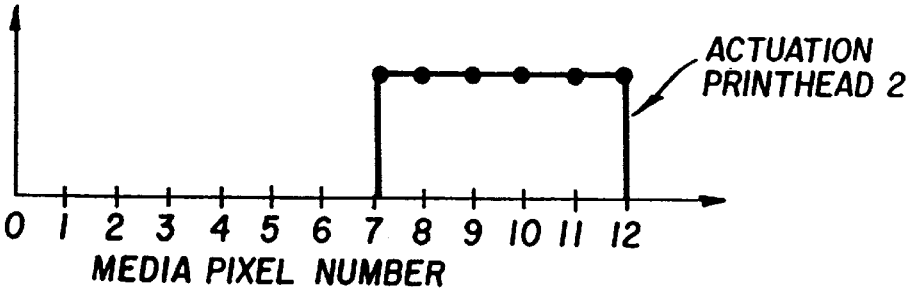
Figure 4G:
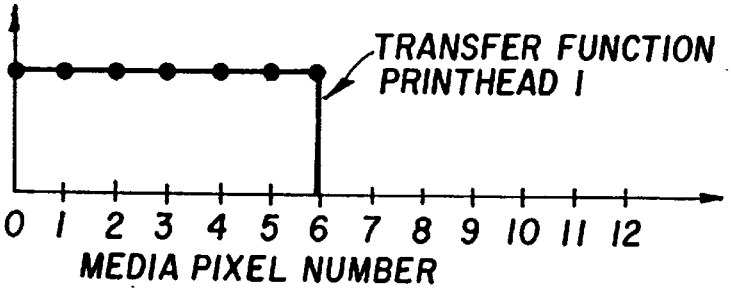
Figure 4H:
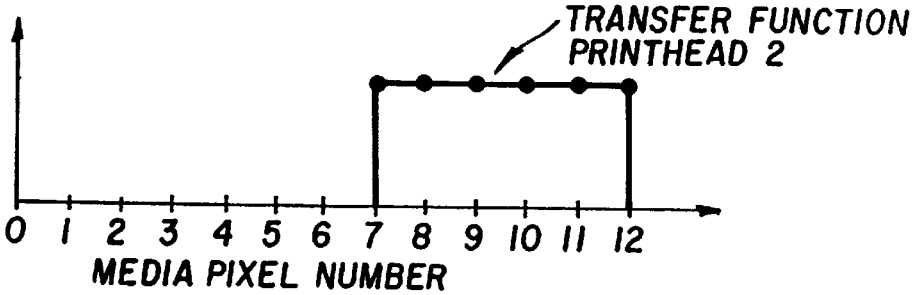
Figure 4I:
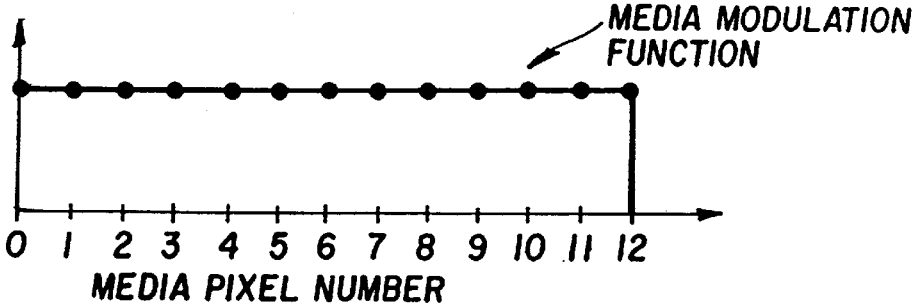
Figure 5A:
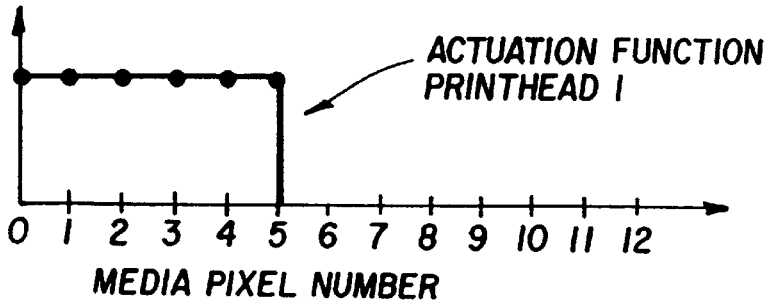
FIGS. 5A–5E graphically represent actuation, transfer, and modulation functions of two overlapping adjacent printhead segments according to the prior art for uniform activation functions and misalignment of the printhead segments by one printing pixel.
Figure 5B:
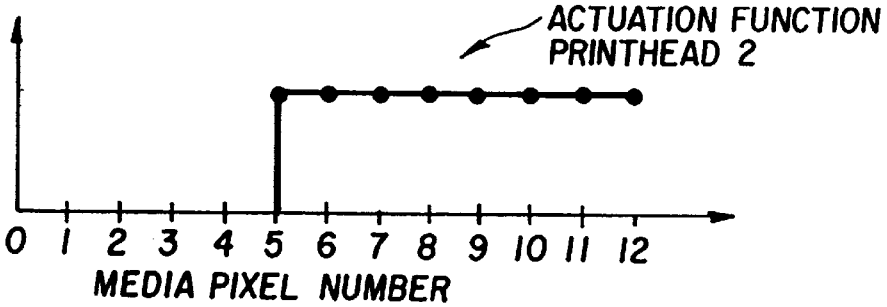
Figure 5C:
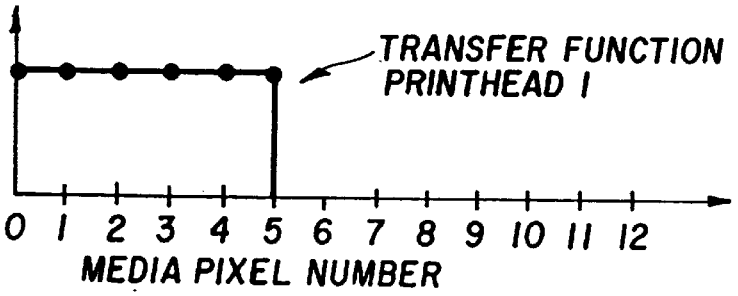
Figure 5D:
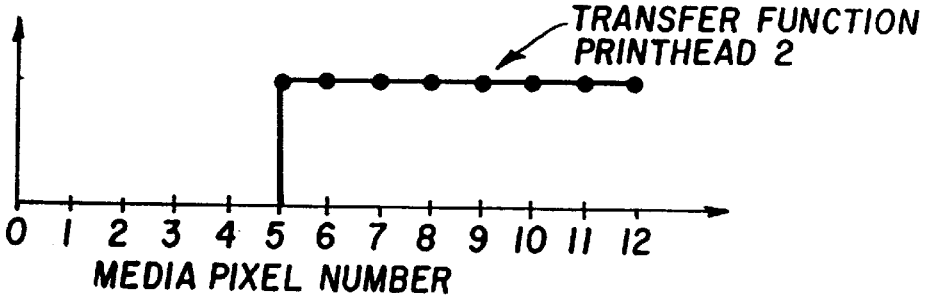
Figure 5E:
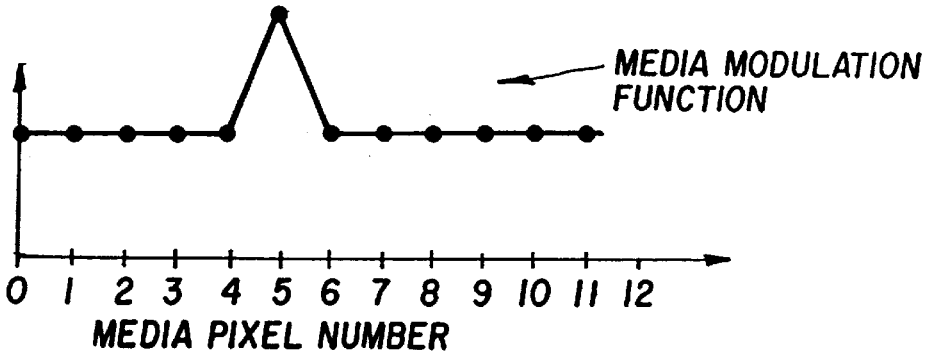
Figure 6A:
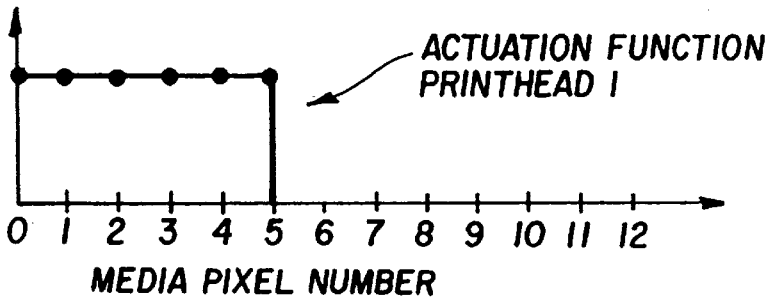
FIGS. 6A–6E graphically represent actuation, transfer, and modulation functions of two gapped adjacent printhead segments according to the prior art.
Figure 6B:
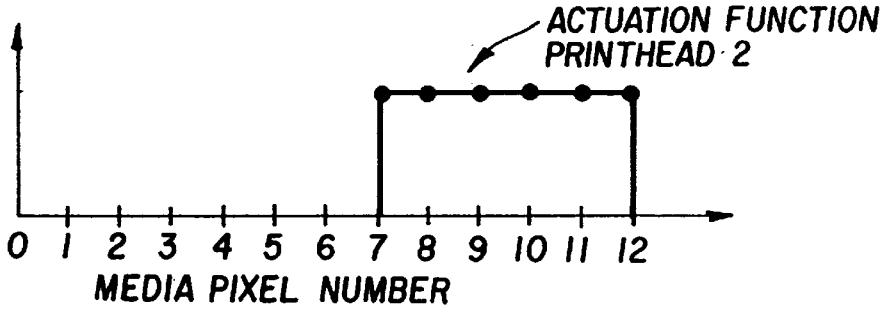
Figure 6C:
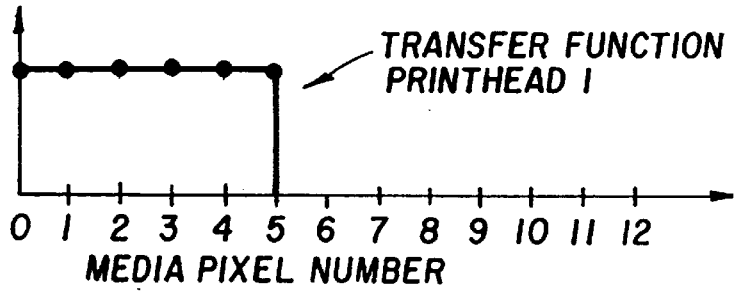
Figure 6D:
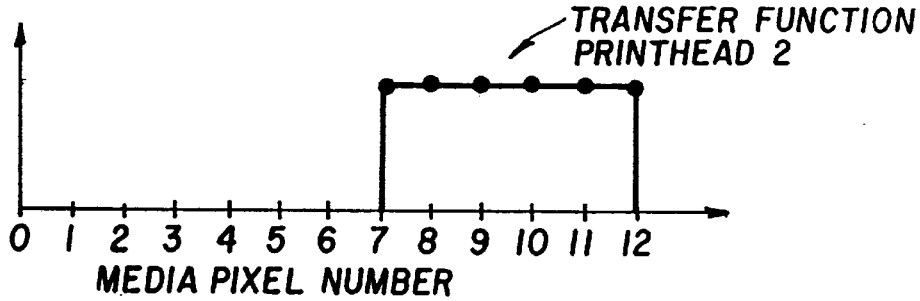
Figure 6E:
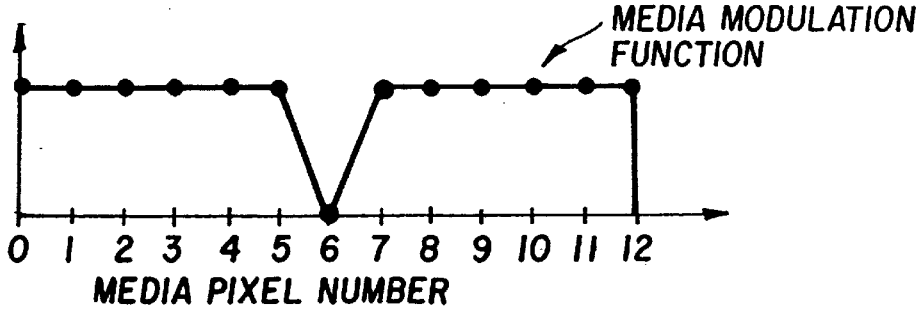

The result (FIG. 7E) in this case is seen to be identical to the result (FIG. 4E) of prior art for a similar region near the boundary of two non-overlapping printhead segments each of whose printing pixels are constructed to be physically identical and whose activation functions are uniform and equal. The transfer function for the prior art device is uniform, i.e., any printing pixel when activated produces substantially the same media modulation function on the image plane. It is a preferred embodiment of the present invention that the printed pixels on the image plane are uniform, as show in FIG. 7E, when the printhead segments are aligned precisely and that the transfer function across each printhead segment varies over a wide range, for example, preferably exhibiting a variation of more than four fold, as illustrated in FIGS. 5, 7A and 7B.

The improvement in operation in accordance with the present invention is seen in the cases of misalignment between adjacent printhead segments as discussed previously for the prior art device of FIGS. 4A–4I, 5A–5E, and 6A–6E. To some degree, misalignment between printhead segments will always occur, thereby causing image artifacts desired to be suppressed or minimized. We discuss the case for which all printing pixels of both printhead segments are activated, corresponding to printhead segment activation functions such as those shown in FIGS. 4E and 4F, 5A and 5B, 6A and 6B, and 7C and 7D. The transfer function for printhead segment 2 in this example is preferable given by Equation 2, below, with the transfer function for printhead segment 1 remaining the same as in Equation 1.

Transfer Function

Equation 2

$$\text{Printhead Segment 2}\quad \begin{cases} \dfrac{(a-b)\left(x+\dfrac{\Delta}{N-1}\right)}{\Delta}+b & \dfrac{\Delta}{N-1}<x\le\Delta\dfrac{N-2}{N-1} \\ a & x\ge\Delta\dfrac{N-2}{N-1} \end{cases}$$

Figure 8A:
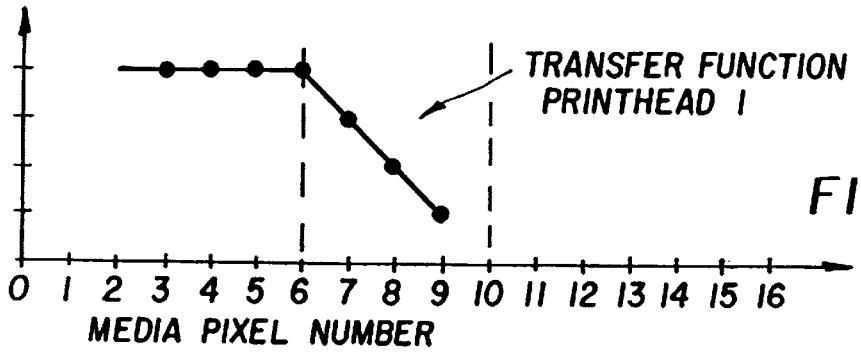
FIGS. 8A–8E graphically represent actuation, transfer, and modulation functions of two overlapping adjacent printhead segments in misalignment by one printing pixel according to the present invention.
Figure 8B:
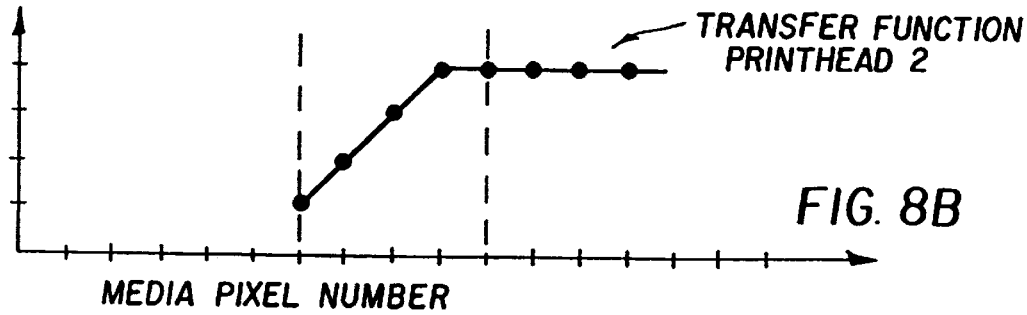
Figure 8C:
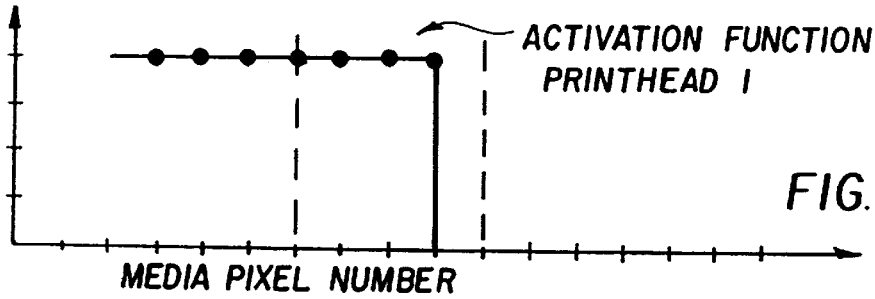
Figure 8D:
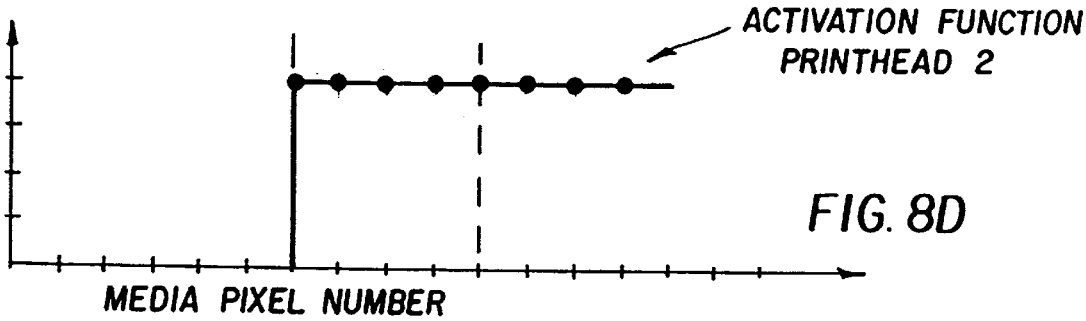
Figure 8E:
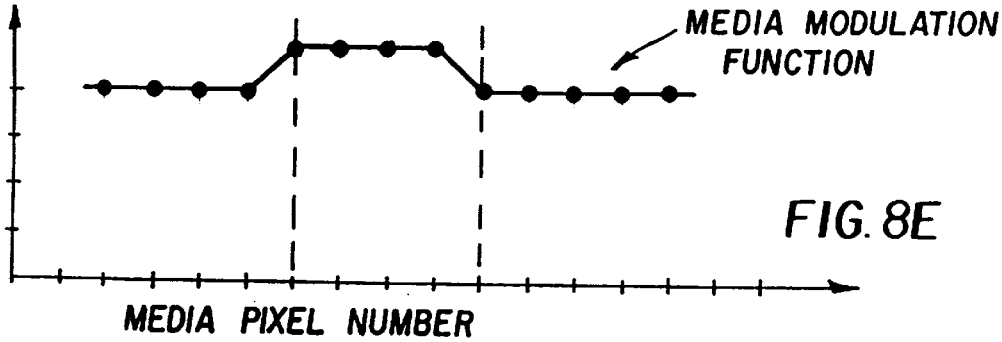

FIGS. 8A–8E illustrate the improved results attained by the present invention when the printhead segments are displaced toward one another. If the transfer function of FIG. 8B is represented by Equation 2, and the transfer function of FIG. 8A remains that given by Equation 1, then the non-uniform transfer functions of first and second printhead segments are shown in FIGS. 8A and 8B. Here, the printhead segments are misaligned by one printing pixel compared to that case of FIGS. 7A–7E. The results shown in FIG. 8E, in which the contributions of both printhead segments are shown added to obtain the printed pixel modulation function on the media sheet, can be compared with the similar calculation for prior art device, FIG. 5E, for which the printing pixels of each printhead segment are identical and for which the printhead segments are also displaced toward one another by one printing pixel. It is clear that although neither FIG. 5E nor FIG. 8E perfectly represent the desired uniform printed pixel modulation function on the image plane, the deviation in the printed pixel modulation function on the image plane from uniformity is smaller in amplitude and is spread to a greater extent spatially for the device made in accordance with the present invention. As is well know in the art of image processing and analysis, such a reduction in the amplitude deviation and an increase in spatially spread are advantageous in reducing image artifacts.

Figure 9A:
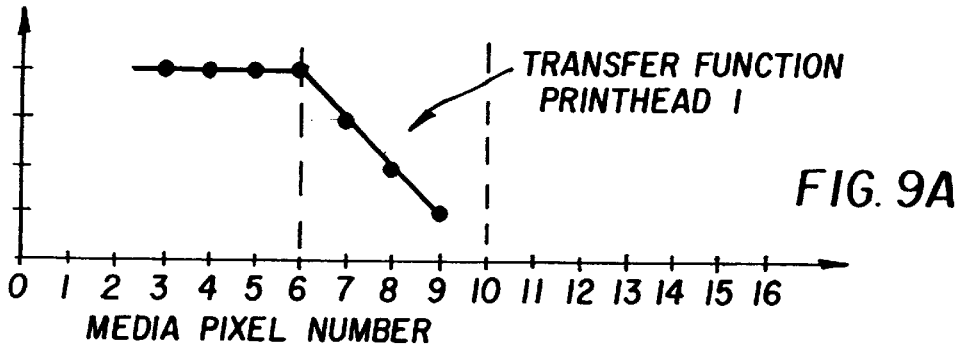
FIGS. 9A–9E graphically represent actuation, transfer, and modulation functions of two overlapping adjacent printhead segments in misalignment by one printing pixel according to the present invention.
Figure 9B:
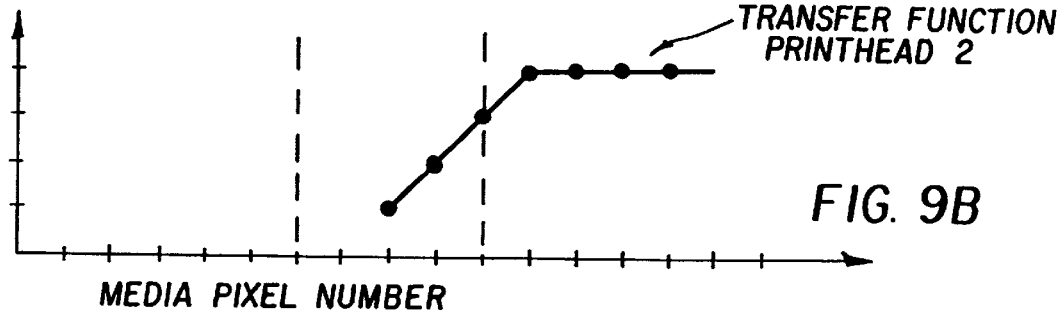
Figure 9C:
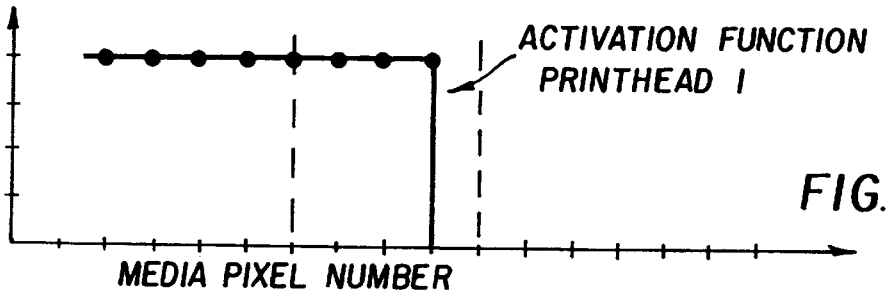
Figure 9D:
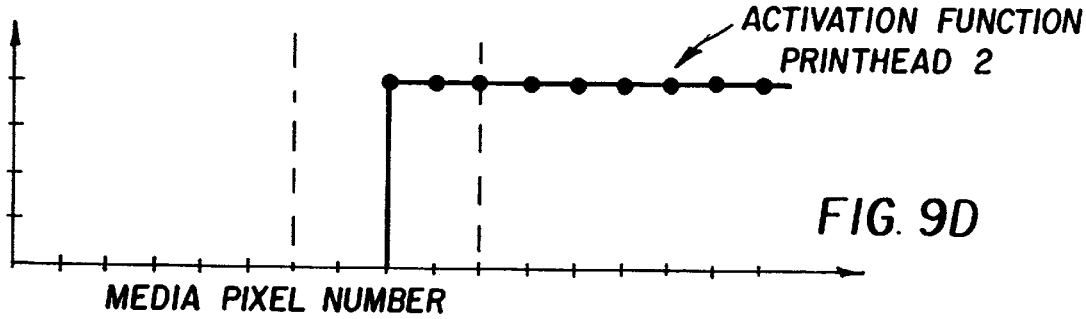
Figure 9E:
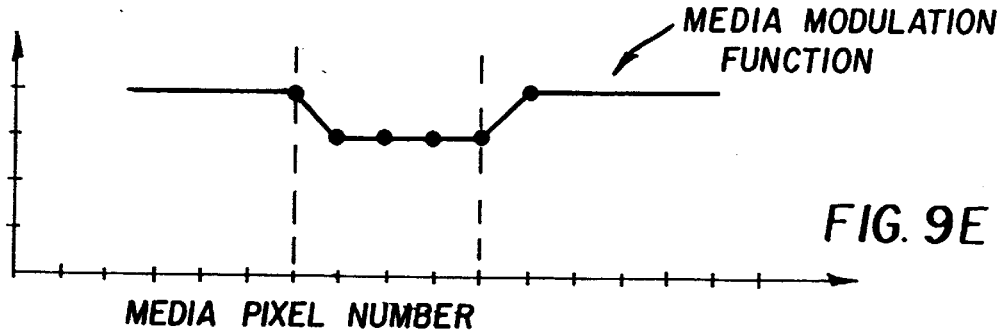

Likewise, when two adjacent printhead segments made in accordance with this invention are misaligned by one pixel by moving the printhead segments further apart, the resulting modulation function applied to the image plane is again calculated by adding the permanent transfer functions, assuming that all printing pixels of both printheads are activated. FIGS. 9A and 9B show the transfer functions of two such printhead segments, respectively. Note that the total modulation function is only slightly smaller than that desired and is spread again across a range of pixels. This creates a lighter and wider band that is much less visible than the abruptly defined band shown in FIG. 6E for the case of misalignment of prior art printhead segments having a uniform transfer function which creates banding, well known to be highly visible to the eye.

A plurality of examples of the of print-head transfer functions available in accordance with the present invention are described below. It is understood that other print-head parameters can be varied alone or in combination to achieve similar effects.

EXAMPLE 1

Figure 10:
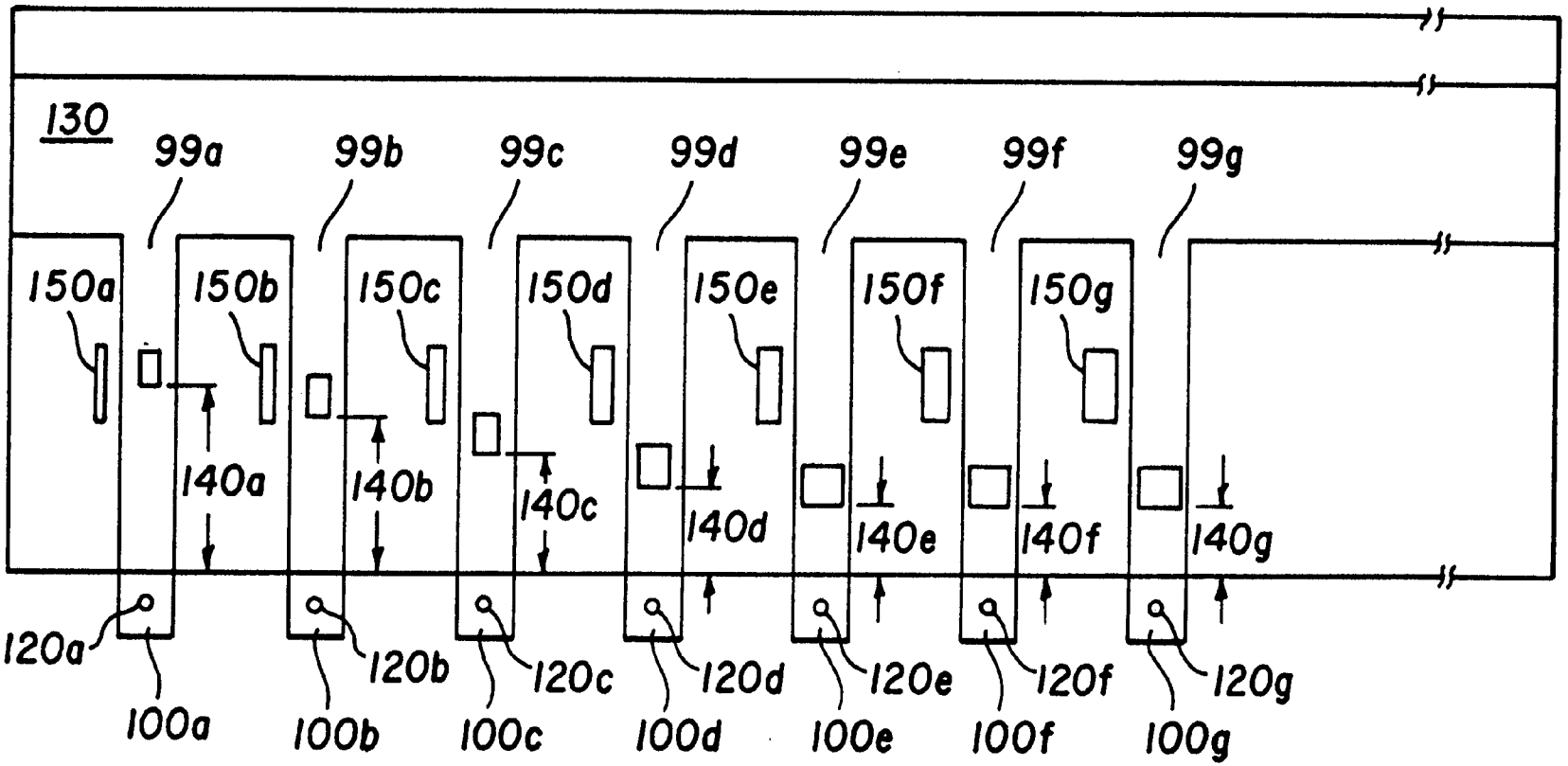
FIG. 10 is a schematic diagram of a thermal ink jet printhead segment consisting of an array of firing chambers.

The nature of the physical characteristics of the nozzles near the ends of printhead segments made in accordance with this invention depend on the specific printhead technology employed and on the method of operation. For print heads of the thermal ink jet type, such as those disclosed in Great Britain Patent No. 2,007,162, which issued to Endo et al. in 1979, the modifications may be made in a variety of ways or by using a combination of ways. FIG. 10 shows such a schematic diagram of a thermal ink jet printhead segment consisting of an array of firing chambers 99*a* to 99*g* comprising resistive elements 100*a* to 100*g*, ink channels 100*a* to 110*g*, and nozzles 120*a* to 120*g*. The ink channels are connected to a common ink supply reservoir 130, as is typical in the art. The distances between the resistive elements and the nozzles are labeled 140*a* to 140*g*. Temperature bias resistors 150*a* to 150*g* are provided to raise the average temperature of ink in their vicinity, as may be required due to high ink viscosity. The designation "a" references the region nearest the end of the printhead segment.

In accordance with this invention, the physical construction of firing chambers 99*a* to 99*e* near the end of the printhead segment is modified. In FIG. 10, the areas of the resistive elements 100*a* to 100*e* are made monotonically smaller so that the volume of the ink bubble, and hence the ejected volume of ink, is smaller near the end of the printhead segment. The resistance values of the elements 100*a* to 100*e* are made larger by altering the patterning of the resistive elements, for example by narrowing the resistors in elements 100*a* to 100*e,* so that the voltages applied to all resistive elements in the printhead are the same. Also in accordance with this invention, the size of nozzles 120*a* to 120*e* are monotonically smaller as shown in FIG. 10, to additionally provide for smaller drop volumes near the ends of the printhead segments. Additionally, the distances 140*a* to 140*e* between the nozzles and the resistive elements increase near the end of the printhead segment to further assure a smaller drop volume in those locations. Temperature bias resistors 150*a* to 150*g* raise the average temperature of ink in their vicinity, as is known in the art of temperature control of ink-jet print heads. Bias resistors 150*a* to 150*e* have larger resistance values near the end of the printhead segment so that a lower bias temperature is established near the printhead segment end under conditions of constant voltage applied to the bias resistors, which reduces drop size, owing to the well known inverse dependence of ink viscosity on temperature.

Some or all of these modifications may be made to the firing chambers near the ends of the printhead segment so that ink drops expelled near the end are substantially smaller than drops expelled in the middle portion of the printhead segment, where the firing chambers are fabricated substantially identically. The exact size of the drops ejected near the printhead segment end will also depends on the materials of construction of the printhead, the type of ink used, and the device operating parameters. The size of the drops ejected near the printhead segment end may be adjusted to achieve the desired media modulation function, for example the media modulation shown in FIG. 7E.

EXAMPLE 2

Figure 11:
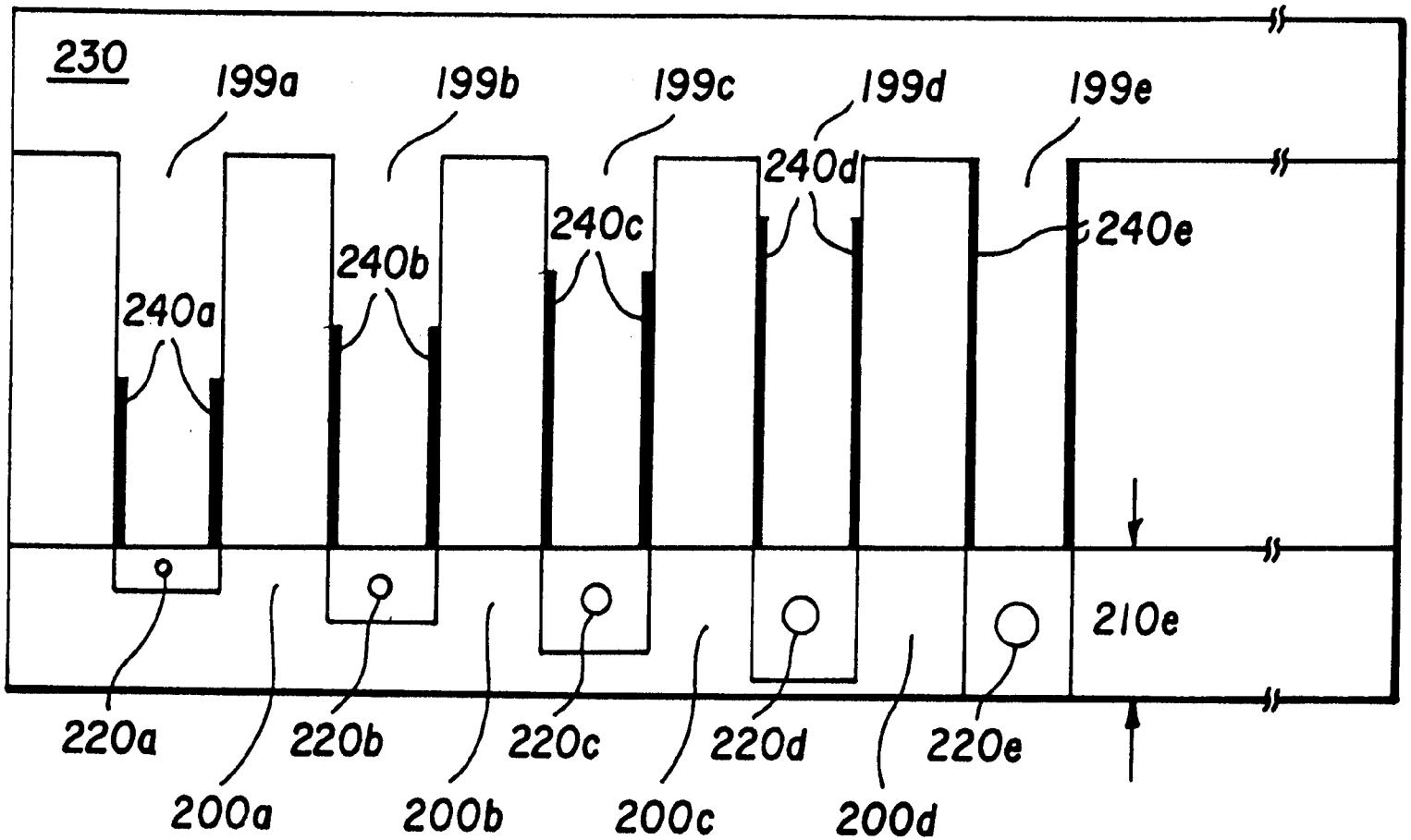
FIG. 11 is a schematic diagram of a particularly designed piezo inkjet printhead.

For print heads of the piezo type, such as those disclosed in U.S. Pat. No. 3,946,398, which issued to Kyser et al. in 1970, the modifications may also be made in a variety of ways or by using a combination of ways. FIG. 11 shows a schematic diagram of a particularly designed piezo ink-jet printhead comprised of ink channels 199*a* to 199*e* of depths 210*a* to 210*e*, walls 200*a* to 200*e*, and nozzles 220*a* to 220*e*. The ink channels are connected to a common ink supply reservoir 230, as is typical in the art. Electrodes 240*a* to 240*e* are provided to cause the walls to bend in a shear mode upon application of a voltage, as is well known in the art of piezo printheads. Although the printhead is of a particular design, the principals of this invention can equally be applied by one skilled in the art to piezo print heads designed in other manners.

In accordance with this invention, the physical construction of ink channels near the end of the printhead segment is modified. For example, FIG. 11 shows modifications of ink channels 199*a* to 199*e*. The areas of the ink channels 199*a* to 199*e* are made monotonically smaller toward the end of the printhead segment by adjusting the depths 210*a* to 210*e* of the ink channels so that the volume change of the ink channels upon application of a voltage decrease monotonically near the printhead segment ends; thereby causing the ejected volume of ink to be smaller near the ends. Concurrently, nozzles 220*a* to 220*e* are made monotonically smaller near the printhead segment ends by reducing the nozzle diameter, thereby causing the ejected volume of ink to be smaller near the ends. Also, the sizes of the electrodes 240*a* to 240*e* are made monotonically smaller, as shown in FIG. 11, by shortening their lengths to additionally provide for a smaller volume change of the ink channels near the ends of the printhead segments upon application of a voltage applied uniformly to all electrodes 240*a* to 240*e*. Alternatively or additionally, the entire length of ink channels 199*a* to 199*e* may be reduced near the printhead segment ends to cause a smaller volume of ink to be expelled near the printhead segment ends.

Some or all of these modifications may be made to the ink channels near the ends of the printhead segment in order that ink drops expelled near the end are substantially smaller than drops expelled in the middle portion of the printhead segment where the firing chambers are fabricated substantially identically. The exact size of the drops ejected near the printhead segment end will also depends on the materials of construction of the printhead, the type of ink used, and the device operating parameters; and may be adjusted to achieve the desired media modulation function, for example the media modulation shown in FIG. 7E.

EXAMPLE 3

For print heads of the type described in commonly assigned, co-pending U.S. patent application Ser. No. 08/750,438 filed in the name of K. Silverbrook and corresponding to PCT/US96/04887 filed Apr. 9, 1996, the modifications may also be made in a variety of ways or by using a combination of ways. In this type ink-jet print head, a constant pressure is applied to the ink solution that causes the ink meniscus to protrude outward off the outlet of each orifice. A heating resistor is fabricated around the exit of each nozzle. When a nozzle is selected to print, the heater resistor is applied with an electric current. The elevated temperature lowers the surface tension of the ink solution, causing the ink solution to eject to the print media. When this type print head is used in the present invention, the heater resistance of each segment of the print-head assembly is monotonically decreased near the end of each segment. Other parameters are held constant across the head segment. This technique results in print-head transfer functions as illustrated in FIGS. 7*a*, 8*a*, and 9*a*.

EXAMPLE 4

Similar to Example 3, for print heads of the type described therein, the modifications on the transfer function may also be made by decreasing the ink pressure in the nozzles near the end of each segment of the print-head assembly. Other print-head parameters are held constant. The ink pressure can be decreased either by applying different pressures in separate ink manifolds for different nozzles, or by flowing the ink solutions at different velocity using the Bernoulli Principle. This technique can also result in print-head transfer functions as illustrated in FIGS. 7*a*, 8*a*, and 9*a*.

Advantages

The present invention enables low-cost and high printing-speed applications. The design idea is generally applicable to digital printers with printheads which deliver either no grayscale or very limited grayscale capability for any given printing pixel. The invention is applicable to both color and black and white printers. The degree of suppression of the banding effects can be optimized by adjusting the width and nature of the overlapping regions at the boundaries between printhead segments at the ends of the printhead segment where the printed pixels are non-uniform so that the banding effect is invisible to eye.

The invention has been described in detail with particular reference to preferred embodiments thereof, but it will be understood that variations and modifications can be effected within the spirit and scope of the invention.

What is claimed is:

1. A binary printhead, comprising:

an array of adjacent segments, each segment having ends, a central portion and a plurality of nozzles, said array of adjacent segments being distributed across the printhead so that adjacent segments overlap only at the ends thereof by a predetermined distance, the printhead being as wide as a full print line in order to print the print line in a single pass of the printhead; and a plurality of printing pixels extending along each segment, said printing pixels having physical characteristics that effect non-uniform transfer functions that decrease toward the ends of segments over the overlap distance so that printing pixels at the ends of segments cooperate to reduce banding or non-uniformity in images printed by the printing pixels located in overlap portions of the segments.

2. A binary printhead as set forth in claim 1, wherein the physical characteristics of the printing pixels are such that their transfer functions vary linearly over the overlap distance.

3. A binary printhead as set forth in claim 1, wherein the physical characteristics of the printing pixels are such the their transfer functions increase monotonically from a first value at the ends of the printhead segments to a second value away from the ends of the printhead segments, the second value being larger than the first value.

4. A binary printhead as set forth in claim 1, wherein the physical characteristics of the printing pixels in the central portion of each segment are uniform are such that their transfer functions are constant over the central portions.

5. A binary printhead as set forth in claim 1, wherein the transfer functions applied to adjacent segments are of mirror symmetry.

6. A binary printhead as set forth in claim 1, wherein the transfer function decreases from a first voltage amplitude to a second voltage amplitude over the overlap distance.

7. A binary printhead as set forth in claim 1, wherein the segments are staggered across the printhead.

8. A binary printhead as set forth in claim 1, wherein:

the printhead is a thermal ink jet type; and the physical characteristics of the printing pixels include different positions of resistive heaters relative to nozzle openings.

9. A binary printhead as set forth in claim 1, wherein:

the printhead is a piezoelectric ink jet type; and the physical characteristics of the printing pixels include different lengths of piezoelectric elements.

10. A binary printhead as set forth in claim 1, wherein:

the printhead is an ink jet type having a plurality of orifices, an ink solution under constant pressure to cause an ink meniscus to protrude outward of each orifice, a resistor surrounding each orifice to which an electric current can be applied to lower the surface tension of the ink solution and cause the ink solution to eject from the orifice; and the physical characteristics of the printing pixels include different resistances for respective ones of the resistors.

11. A binary printhead as set forth in claim 1, wherein:

the printhead is a ink jet type having a plurality of orifices, an ink solution under a respective pressure to cause an ink meniscus to protrude outward of each respective orifice, a resistor adjacent to each orifice to which an electric current can be applied to lower the surface tension of the ink solution and cause the ink solution to eject from the orifice; and the physical characteristics of the printing pixels include different pressures for respective ones of the orifices.

12. A process of operating a binary printhead, comprising the steps of:

providing an array of adjacent segments across the printhead, each segment having ends, a central portion and a plurality of nozzles, so that adjacent segments overlap only at the ends thereof by a predetermined distance, the printhead being as wide as a full print line in order to print the print line in a single pass of the printhead; and actuating a plurality of printing pixels extending along each segment, said printing pixels having physical characteristics that effect non-uniform transfer functions that decrease toward the ends of segments over the overlap distance so that printing pixels at the ends of segments cooperate to reduce banding or non-uniformity in images printed by printing pixels located in overlap portions of the segments.

13. A process of operating a binary printhead as set forth in claim 12, wherein the physical characteristics of the provided printing pixels are such that their transfer functions vary linearly over the overlap distance.

14. A process of operating a binary printhead as set forth in claim 12, wherein the physical characteristics of the provided printing pixels are such the their transfer functions increase monotonically from a first value at the ends of the printhead segments to a second value away from the ends of the printhead segments, the second value being larger than the first value.

15. A process of operating a binary printhead as set forth in claim 12, wherein the physical characteristics of the provided printing pixels in the central portion of each segment are uniform are such the their transfer functions are constant over the central portions.

16. A process of operating a binary printhead as set forth in claim 13, wherein the transfer functions applied to adjacent segments are of mirror symmetry.

17. A process of operating a binary printhead as set forth in claim 12, wherein the transfer function decreases from a first amplitude to a second amplitude over the overlap distance.

18. A process of operating a binary printhead as set forth in claim 12, wherein the segments are staggered across the printhead.

19. A process of operating a binary printhead as set forth in claim 12, wherein:

the printhead is a thermal ink jet type; and the physical differences of the printing pixels include different positions of resistive heaters relative to nozzle openings.

20. A process of operating a binary printhead as set forth in claim 12, wherein:

the printhead is a piezoelectric ink jet type; and the physical differences of the printing pixels include different lengths of piezoelectric elements.

21. A process of operating a binary printhead as set forth in claim 12, wherein:

the printhead is a ink jet type having a plurality of orifices, a constant pressure is imparted to an ink solution to cause an ink meniscus to protrude outward of each orifice, a heating resistor surrounding each orifice is enabled with an electric current to lower the surface tension of the ink solution in the meniscus and cause the ink solution to eject from the orifice; and the physical characteristics of the printing pixels include different resistances for respective ones of the resistors.

22. A process of operating a binary printhead as set forth in claim 12, wherein:

the printhead is a ink jet type having a plurality of orifices, an ink solution under pressure causes an ink meniscus to protrude outward of each orifice, a heating resistor around each orifice is enabled with an electric current to lower the surface tension of the ink solution and cause the ink solution to eject from the orifice; and the physical characteristics of the printing pixels provide different ink pressures for respective ones of the orifices.

* * * * *